US005996298A

United States Patent [19]

Wenzlaff et al.

[11] Patent Number: 5,996,298

[45] Date of Patent: Dec. 7, 1999

[54] MODULAR SHUTTER

[75] Inventors: John C. Wenzlaff, Wonder Lake; Michael J. Ricard, Prospect Heights, both of Ill.

[73] Assignee: Shutters, Inc., Hebron, Ill.

[21] Appl. No.: 08/986,870

[22] Filed: Dec. 8, 1997

[51] Int. Cl.[6] ..... E06B 7/08

[52] U.S. Cl. ..... 52/473; 52/586.2

[58] Field of Search ..... 52/473, 586.2, 52/309.1, 474, 202; 403/331, 335, 336, 338, 363, 381

[56] References Cited

U.S. PATENT DOCUMENTS

| | | |
|---|---|---|
| 1,771,304 | 7/1930 | MacGruder . |
| 3,055,467 | 9/1962 | Peek et al. . |
| 3,455,079 | 7/1969 | Frederick . |
| 3,548,555 | 12/1970 | Trostole et al. . |
| 3,797,186 | 3/1974 | Smith . |
| 4,023,320 | 5/1977 | Jackson . |
| 4,251,966 | 2/1981 | Foltman . |
| 4,765,110 | 8/1988 | MacLeod . |
| 4,858,400 | 8/1989 | Foyt . |
| 4,967,511 | 11/1990 | Werginz et al. . |
| 5,060,442 | 10/1991 | Chubb . |
| 5,152,116 | 10/1992 | MacGowan . |
| 5,265,391 | 11/1993 | Ricard et al. . |
| 5,524,407 | 6/1996 | Ricard et al. . |

FOREIGN PATENT DOCUMENTS

| | | |
|---|---|---|
| 792951 | 7/1935 | France . |

*Primary Examiner*—Beth Aubrey
*Attorney, Agent, or Firm*—Rockey, Milnamow & Katz

[57] ABSTRACT

An adjustable, fastenerless modular shutter includes a pair of side rails, at least one shutter panel and a pair of end rails. A center rail can be provided. The side rails and end rails are mutually connected to form a frame for holding one or more shutter panels and center rails. Each end rails and the center rail has a front wall and a pair of runner portions having locking portions. The locking portions are slidably receivable in the pair of side rails and include interferingly, frictionally engaging projections for engaging the side rails to resist separation of the end rails from the side rails during assembly of the shutter. The side rails include front inwardly directed lips which assist in retaining the shutter panelis), the center rail and the end rails, particularly the runner portions. The end rails and the center rail include front surfaces raised from their respective runner portions to be planar with front surfaces of the side rails when the shutter is assembled. An overall aesthetically pleasing architectural appearance is achieved.

16 Claims, 2 Drawing Sheets

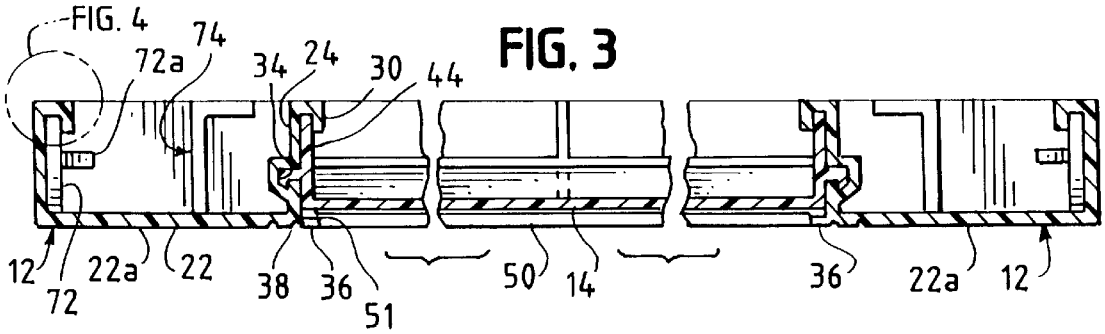
FIG. 3
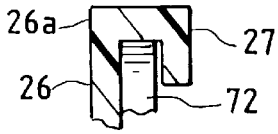
FIG. 4
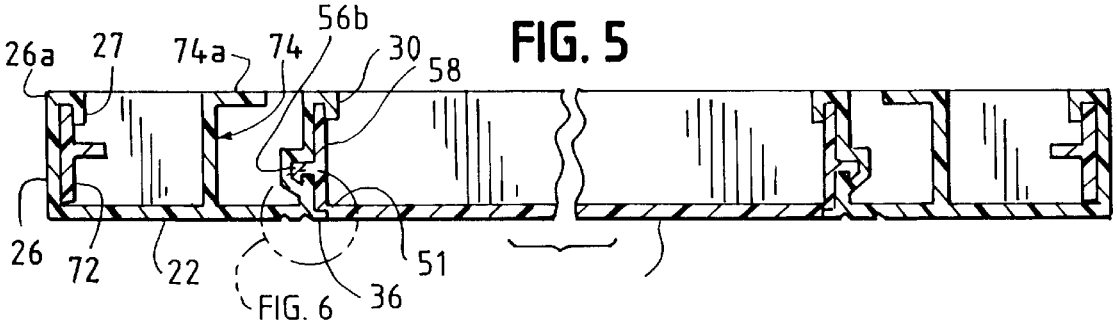
FIG. 5
FIG. 6
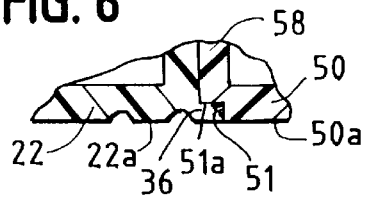
FIG. 7
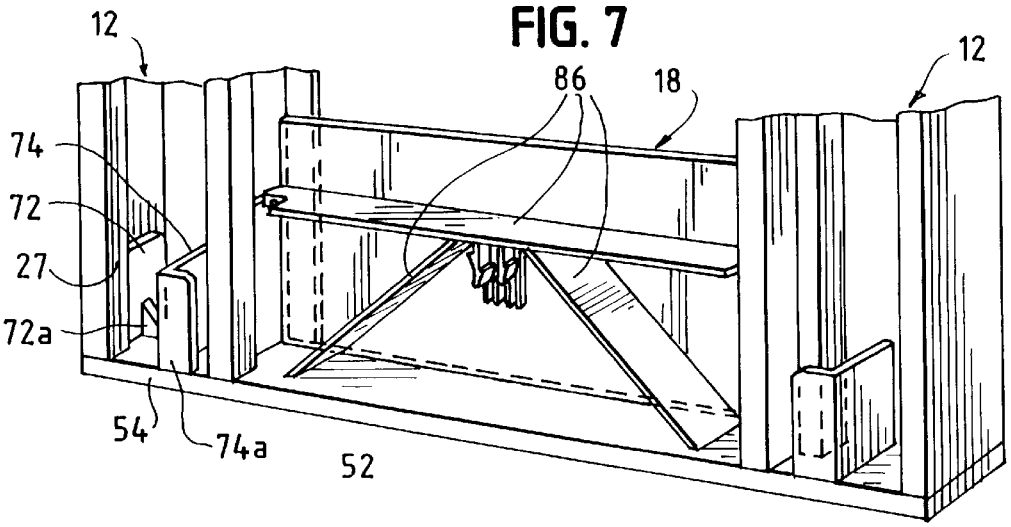

MODULAR SHUTTER

FIELD OF THE INVENTION

This invention pertains to building shutters, and more particularly to modular shutters assembled from side rails and end rails which are rigidly mutually connected and which provide an aesthetically attractive frontal appearance.

BACKGROUND OF THE INVENTION

A variety of decorative building shutters are available for installation adjacent to openings in buildings, such as windows. One popular type of shutter which is available is assembled from modular components which are available in a range of sizes. Such modular shutters are easily tailored for particular installations.

Examples of such modular shutters are disclosed in U.S. Pat. Nos. 4,251,966 to Foltman, entitled "Adjustable Height Shutter", 5,152,166 to MacGowan, entitled "Modular Shutter Assembly", and 5,265,391 to Ricard et al., entitled "Stabilized Modular Shutter", all of which patents are assigned to the assignee of this application. Other examples of modular shutters are disclosed in U.S. Pat. Nos. 4,765,110 to MacLeod, entitled "Adjustable Plastic Shutter" and 5,060,442 to Chubb, entitled "Louvered Plastic Building Product."

Typically, modular shutters have a pair of side rails, a central shutter panel which, for example, may be planar or louvered, and top and bottom end rails. Generally, the side rails are cut to meet the particular size requirements of the shutter installation. The shutter panels are cut or sized accordingly. The width of modular shutters can be adjusted by use of shutter panels, end rails and mullions of different dimensions.

In many existing modular shutters, each shutter panel has a pair of runners extending along the opposite sides of the panel, transverse to the plane of the shutter panel. Typically, each of the side rails of such modular shutters has a channel formed on the inner wall thereof to slidably receive the runners of the shutter panel. The channel includes a front lip extending inwardly from a front edge of the inner wall and overlying an edge portion of the shutter panel.

The end rails of many shutters also include runner portions which are slidably received in the side rails. The side rails can be C-shaped in cross section with inner and outer walls. Typically, such end rails also include depending tab-like portions which project into the side rails at the ends thereof, against the outer wall to retain the shape of the side rail and to properly position the end rail thereon.

In assembling such shutters, the end rails are assembled to the side rails. One end rail can be assembled before the central panel and side rails are assembled. Typically, the side rails and end rails are fastened together, such as by stapling, to prevent separation thereof. The side and end rails are fastened along the portion where the end rail runner and side rail inner wall are adjacent to each other. While temporarily fastening the shutter in the assembled configuration with fasteners facilitates installation, it is nevertheless a time consuming and laborious task. When the shutter is installed, for example, adjacent to a window on a building surface, screws or other fasteners are driven through the side rails to secure the shutter to the building surface.

In known modular shutters, the end rails and center rails are configured to be attached to the side rails by interfitting into the channel on the inner wall beneath the front lip. The end rails and center rail include a front wall surface which is slightly recessed from the front wall surface of the side rails to fit beneath the lip.

When assembled, this also simplified the configuration of the end rails for insertion of the runner portions into the side rails. However, this presents an uneven and less than optimal appearance of the finished shutter.

SUMMARY OF THE INVENTION

A modular shutter incorporating the present invention includes a pair of side rails, one or more panel members disposed between and secured to the side rails, and end rails secured to the side rails. The end rails are disposed at either end of the panel member for enclosing the panel member. A center rail or mullion can also be provided.

The end rails (and center rail if present) are configured to include raised front surfaces which are planar with front surfaces of the side rails. The raised front surfaces of the end rails and the center rail and the front surfaces of the side rails together provide a planar flush appearance which is a more aesthetically pleasing architectural design. The modular shutter in accordance with the present invention incorporates side rails and end rails which are configured to be mutually engageable in a rigid fashion to limit separation and disengagement of the end rails from the side rails prior to installation, without the use of extra fasteners, such as staples. The modular shutter provides an interfering engagement configuration which frictionally secures the end rails to the side rails during assembly. Such a configuration includes a locking portion, such as on the end rail, which interferingly, frictionally engages the respective other rail, such as the side rail, for resisting disengagement of the end rails from the side rails after assembly.

Each of the side rails has a front wall, a generally planar inner wall, and an outer wall. The side rails are spaced apart one from the other with the inner walls facing each other and lying in generally parallel planes. The side rails include channeled outer edges, and the end rails include alignment tabs which engage the channeled outer edges.

The side rails each include an inwardly directed front lip extending from a front edge of a respective inner wall which overhangs the panel member(s), the center rail, and the end rails when the shutter is asembled. The side rails can each include an L-shaped hook wall at a rear edge of the respective inner wall which forms a C-shaped channel with the respective front lip. An L-shaped recess can be provided in each of the inner walls. The panel member(s), center rail, and end rails each have a central portion and a pair of runner portions disposed along the sides thereof. The runner portions are oriented generally parallel to the inner walls of the side rails. The runner portions are fit within the C-shaped channels. Each of the runner portions includes at least one L-shaped hook which is engagable with an L-shaped recess formed into the inner wall of an associated side rail to secure the panel member(s), center rail and end rails to each of the side rails.

The center rail and end rails include front walls having front surfaces which are raised from front edges of their associated runner portions. When installed to the side rails the runner portions underlie the front lips of the side rails, and the front surfaces of the center rail and end rails are flush or planar with front surfaces of the front walls of the side rails.

The fastenerless shutter in accordance with the present invention aligns and secures the end rails and sides rails together, without extra fasteners, during assembly, and thus improves the resistance against disengagement (i.e., achieves a secure engagement) of the modular shutter assembly. By securing the components together during assembly without requiring additional procedures, such as the use of fasteners, the assembly of shutters is simpler and faster, and the cost of assembly is reduced due to the reduction in assembly time and the elimination of fasteners.

Numerous other advantages and features of the present invention will become readily apparent from the following detailed description of the invention and embodiments thereof, from the claims, and from the accompanying drawings in which the details of the invention are fully and completely disclosed as a part of the specification.

BRIEF DESCRIPTION OF THE DRAWINGS

FIG. 3 is cross-sectional view taken along line 3—3 of FIG. 1;

FIG. 4 is an enlarged section view taken from FIG. 3;

FIG. 5 is a cross-sectional view taken along line 4—4 of FIG. 1;

FIG. 6 is an enlarged sectional view of a portion of FIG. 5; and

FIG. 7 a fragmentary rear perspective view of the shutter shown in FIG. 1.

DETAILED DESCRIPTION OF THE PREFERRED EMBODIMENTS

Figure 1:
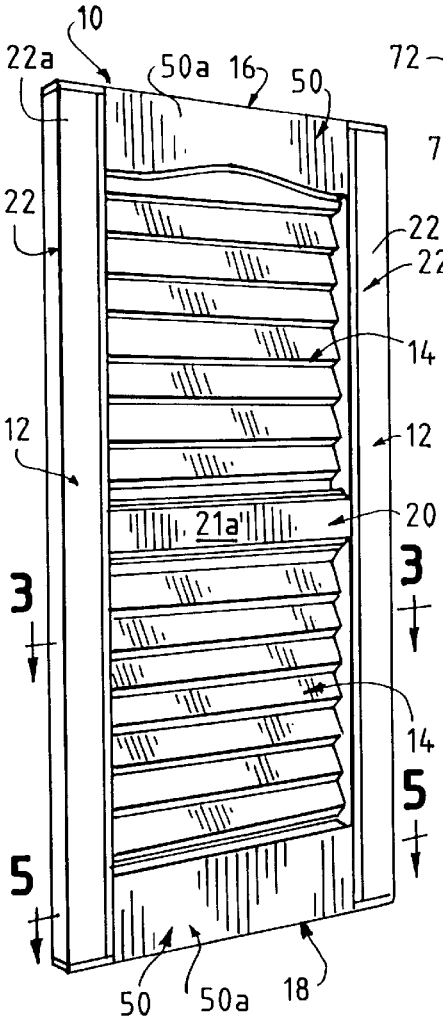
FIG. 1 is a perspective view of an embodiment of a modular shutter which embodies the principles of the invention.

While this invention is susceptible of embodiment in many different forms, there is shown in the drawings and will be described herein in detail, specific embodiments thereof with the understanding that the present disclosure is to be considered an exemplification of the principles of the invention and is not intended to limit the invention to the specific embodiments illustrated.

There is shown in FIG. 1 a fastenerless modular shutter 10 comprising a pair of side rails 12, one or more shutter panel members 14, a top end rail 16, and a bottom end rail 18. When, as shown in FIGS. 1 and 2, the shutter 10 includes more than one panel member 14, a mullion or center rail 20 may be disposed between adjacent panel members 14.

Figure 2:
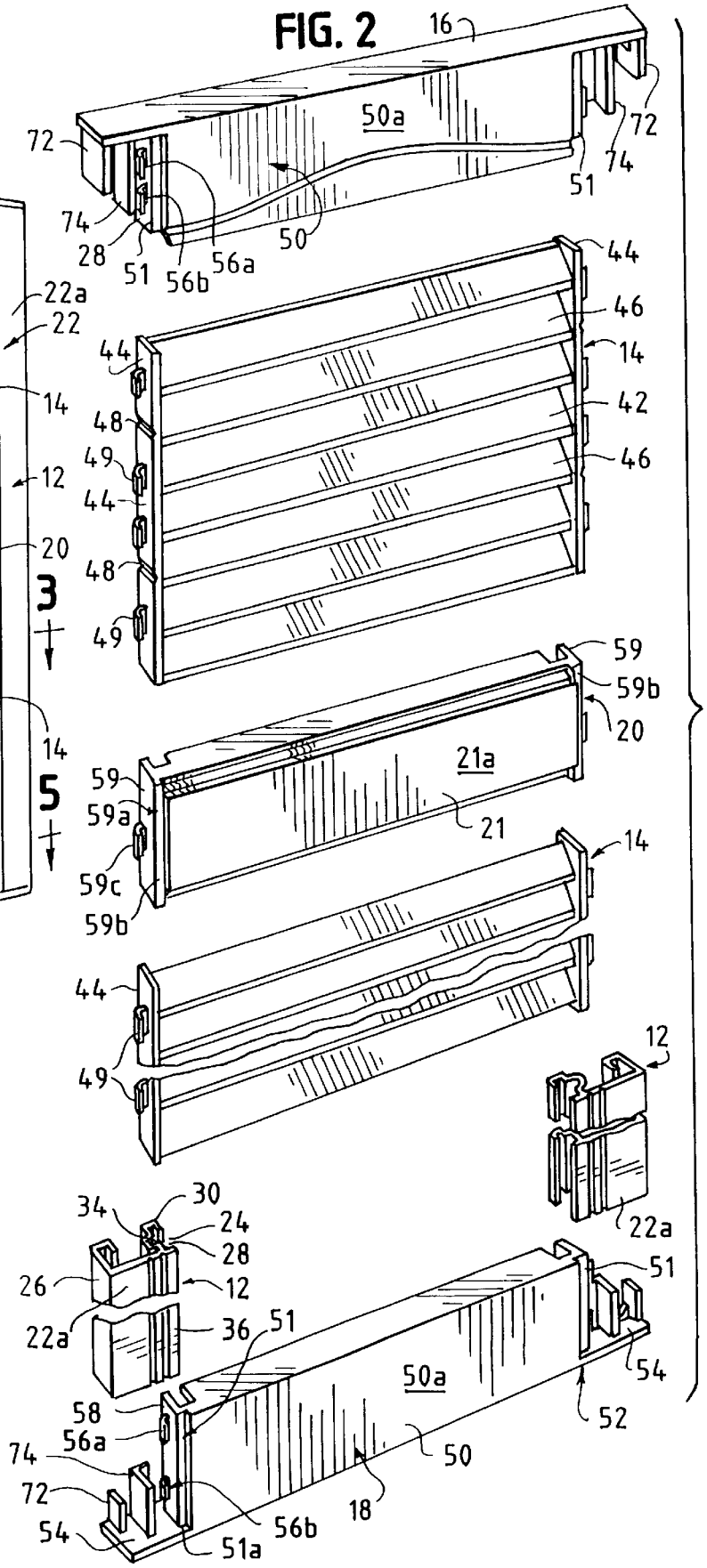
FIG. 2 is an enlarged, exploded, perspective view of the modular shutter of FIG. 1.

Referring now to FIGS. 2 and 3, each side rail includes a front wall 22 having a front surface 22*a*, an inner wall 24 and an outer wall 26, and is formed in a generally C-shaped cross section. In one embodiment, each rail 12 includes a track 28 which may include a hook portion 30 at an end thereof. Each rail 12 may also include an offset retaining channel or slot 34 which interrupts the plane of the inner wall 24. Such a configuration is described for example in U.S. Pat. No. 5,524,407, and co-pending U.S. Pat. Application Ser. No. 08/825,274 filed Mar. 27, 1997, which are commonly assigned herewith.

The offset retaining channel 34 may have any number of shapes, such as the exemplary L-shaped cross-section best seen in FIG. 3. Each side rail 12 also includes a front lip 36 extending from the front wall 22, inwardly relative to the shutter panel 14, at an edge 38 opposing the hook portion 30, and adjacent the inner wall 24.

Each shutter panel 14 has a central portion 42 and includes a pair of runners or mounting flanges 44, which extend along opposite sides of the panel 14 and run the length thereof. The runners 44 are oriented generally transverse to the plane of the central portion 42.

The panel 14 may include a plurality of louvers 46 extending transverse to and between the runners 44, and score lines 48 in the runners 44 corresponding to selected locations between the louvers 44. The score lines 48 facilitate separation of the panels 14 into shorter lengths according to the requirements of the particular installation. The runners 44 slide into the track 28 of the side rails 12. The runners include L-shaped locking portions 49 which frictionally engage into the retaining channel 34.

The center rail 20 includes a front wall 21 connected to runner portions 59. The runner portions 59 extend rearwardly from the front wall 21 and transversely to the plane of the front wall 21. The runner portions 59 are slidably received into the channels 28. The runner portions 59 include hook portions 59*c* which are frictionally held within the retaining channel 34. Recesses 59*a,* arranged between the front wall and the runner portions 59, are sized and configured to receive the lips 36 of the side rails 12 therein when the center rail or mullion 20 is installed. The front lips 36 are received in the recesses 59a in a fashion similar to that shown in FIG. 6, wherein the front lip 36 is shown received into a similar recess 51 of the end rail, as described below. The front wall 21 has a raised front surface 21a flush with the front surfaces 22*a* of the side rails when connected to the side rails 12. The raised front surface 21*a* is raised with respect to a front edge 59*b* of the runner portions 59.

The top and bottom end rails or end caps, 16 and 18, respectively, are generally similarly formed. Each includes a front wall 50, and an end wall portion 52 formed adjacent and generally transverse thereto. The end wall portion 52 includes a pair of winglike extensions 54 which extend from the ends thereof, a distance sufficient to engage or cover the side rails 12.

As shown in FIGS. 2 and 5, the end rails 16 and 18 each includes locking portions 56*a*, 56*b* which extends along each of two runner portions 58. The runner portions 58 extends rearwardly from and transverse to the front wall 50 at opposite ends of the front wall.

As illustrated in FIGS. 2 through 6, between the front wall 50 and the two runner portions 58 are arranged longitudinal recesses 51 such that the front wall 50 includes a raised front surface 50*a* which is raised from a front edge 51*a* of the runner portions 58. The recesses 51 receive the lips 36 of the side rails as shown in FIG. 6. In this manner the front surface 50*a* of the front wall 50 is flush with, or planar with the front wall surfaces 22*a* of rail members 12 when installed. By providing the flush surfaces 50*a* and 22*a* a more attractive shutter is provided for architectural aesthetic appeal.

The locking portions 56*a,* 56*b* include L-shaped hooks which have a shape complementary to the shape of the retaining channel 34 of the side rail 12. The locking portions 56*a,* 56*b* are configured to interferingly, slidably engage the retaining channel 34 of the side rail 12 when the side rail 12 and end rails 16, 18 are assembled together.

The end rails 16, 18 include a pair of aligning tabs 72 which depend from the wing-like extensions 54, and align the end rails 16, 18 with their associated side rails 12. Each tab 72 includes a reinforcing gusset 72*a*. The end rails 16, 18 also include L-shaped mounting flanges 74 which depend from the wing-like extensions 54, and have rear legs 74*a* which are oriented generally parallel to a shutter mounting surface.

The mounting flanges 74 prevents or minimizes dimpling of the front wall 22 due to over-driving of fasteners when mounting the shutter to the mounting surface.

Extending from a back edge 26*a* of the outer wall 26 of each side rail is an L-shaped hook portion 27 which extends the length of the side rail 12. The L-shaped hook portion receives the aligning tab 72 of the end rail members as shown in FIG. 4. This engagement between the L-shaped hook portions 27 and the aligning tab 72 provides a increases rigidity at the bottom of the shutter, particularly at the outer edges thereof. The side rails 12 are prohibited from separating from the end rails due to fastener overtightening into the mounting surface. Additionally, the L-shaped hook member 27 extends the entire length of each of the side rails 12 and adds bending rigidity to the rail members 12, as well as the entire shutter assembly 10 along its length.

FIG. 7 illustrates a rear view of the end rail 18 engaged to two side rails 12. On a rear side at the front wall 50 are reinforcing walls 86 which help rigidify the end rail 18 and the modular shutter 10. After assembly, the end rail 18 is permanently fixed to the side rails 12 by mechanical means such as by staples pushed through the inner wall 24 and the runner portion 58.

Thus, there has been disclosed an aesthetically pleasing modular shutter having side rails, center rail and end rails with flush or planar front surfaces and which includes frictionally, interferingly engaging members which permit assembly of the shutter without extra fasteners, such as staples. The fastenerless modular shutter which incorporates side rails and end rails which are readily alignable and are configured to restrict and limit separation of the rails from each other prior to installation.

From the foregoing, it will be observed that numerous variations and modifications may be effected without departing from the true spirit and scope of the novel concepts of the present invention. It is to be understood that no limitation with respect to the specific embodiments illustrated herein is intended or should be inferred. It is, of course, intended to cover by the appended claims all such modifications as fall within the scope of the appended claims.

What is claimed is:

1. A modular shutter comprising:

a pair of side rails, a panel member disposed between and secured to said side rails, and a pair of end rails secured to said side rails and disposed at ends of said panel member for enclosing said panel member;

each of said side rails having a front wall with a front wall surface, a generally planar inner wall and an outer wall, said side rails being spaced apart one from the other with said inner walls facing each other and lying in generally parallel planes, and a front lip extending inwardly from a front edge of each of said inner walls;

each of said end rails having a front wall and runner portions connected to opposite lateral ends of said front wall, each of said runner portions fit against one of said inner walls and rearwardly of one of said front lips of said pair of side rails;

wherein said front wall of each of said end rails includes a front surface which extends fowardly from front edges of said runner portions planar with said front wall surface of said pair of side rails.

2. The modular shutter as claimed in claim 1 further comprising a center rail having a center rail front wall and center rail runner portions connected to said center rail front wall at front edges of said center rail runner portions and extending rearwardly from said center rail front wall and transversely to said center rail front wall at opposite lateral edges of said center rail front wall, said center rail front wall having a center rail front surface which extends fowardly from said front edges of said center rail runner portions, and said center rail front surface is planar with said front wall surfaces of said pair of side rails.

3. The modular shutter as claimed in claim 1, wherein each of said end rails includes an end wall portion, said end wall portion being oriented transverse to said front wall and extending rearwardly therefrom and said runner portions are slidably received in a channel formed on said side rails, and including a locking portion being formed on each of said runner portions for frictionally engaging said inner walls of said side rail to resist disengagement of said end rails from said side rails.

4. The modular shutter as claimed in claim 3, wherein said inner wall of each side rail defines an L-shaped track, and each of said locking portion includes a hook portion for. engaging said L-shaped track for resisting separation of said end rails from said side rails.

5. The modular shutter as claimed in claim 4 wherein each of said hook portions is L-shaped and tightly interfits within one of said L-shaped track for resisting separation of said end rails from said side rails.

6. The modular shutter as claimed in claim 4, wherein the inner wall of each said side rail has a hook wall formed on a rear edge thereof to slidingly receive a rear edge of each of said runner portions of the end rails.

7. The modular shutter as claimed in claim 1 further comprising a center rail having a pair of locking portions slidably receivable in said side rails and a front wall portion being raised therefrom to be flush with said front walls of said side rails.

8. The modular shutter as claimed in claim 1 wherein each of said side rail further defines a retaining channel formed therein, at least a portion of each of said retaining channels being offset from a plane of the inner walls, each of said end rail including a projection having a shape which is complementary to the shape of said retaining channels and being configured for interferingly, slidably engaging said retaining channel for resisting separation of said end rail from said side rails.

9. The modular shutter as claimed in claim 1 wherein said runner portions of said end rails include locking portions engagable to said inner walls of said side rails.

10. The modular shutter as claimed in claim 1 further comprising a hook portion connected to a rear edge of each inner wall forming a C-shaped channel with each of said front lip on said side rail for receiving said runner portions.

11. A modular shutter comprising:

a pair of side rails, a panel member disposed between and secured to said side rails, and end rails secured to said side rails and disposed at ends of said panel member for enclosing said panel member;

each of said side rails having a front wall with a front surface, a generally planar inner wall, and an outer wall, said side rails being spaced apart one from the other with said inner walls facing each other and lying in generally parallel planes;

said panel member having a central portion and a pair of runner portions disposed along the sides thereof, said runner portions being oriented generally parallel to said inner walls of said side rails, each of said runner portions being engagable with one of said side rail to secure said panel member to each of said side rails; and said end rails each having a front wall portion having a front surface planar with said front surface of said side rails, and e including an engaging portion slidably receivable in said side rails for resisting disengagement of said end rails from said side rails.

12. The modular shutter as claimed in claim 11 further comprising a second panel member disposed between and secured to said side rails, and a center rail disposed between and secured to said side rails, said center rail located between said panel member and said second panel memeber, said center rail having a front surface planar with said front surfaces of said side rails.

13. The modular shutter as claimed in claim 11 wherein said side rails include inwardly directed lips which overhang edge portions of said end rails, said end rails having recesses for receiving said lips, said lips having front surfaces planar with said front surfaces of said side rails and said front surfaces of said end rails.

14. The modular shutter as claimed in claim 11 wherein each of said engaging portions includes at least one, interference member frictionally engagable with said side rail.

15. The modular shutter as claimed in claim 14 wherein each of said interference member extends generally transverse to a front plane of said side rails.

16. The modular shutter as claimed in claim 14 wherein said interference member engages said side rail along an outer portion thereof.

* * * * *